United States Patent [19]

Beard

[11] 4,367,515

[45] Jan. 4, 1983

[54] ROLLER SKATE LIGHT ATTACHMENT

[76] Inventor: Steven F. Beard, 885 Linn-Hipsher Rd., Marion, Ohio 43302

[21] Appl. No.: 201,776

[22] Filed: Oct. 29, 1980

[51] Int. Cl.[3] ..... F21L 5/00; F21L 11/00; F21L 15/08

[52] U.S. Cl. ..... 362/103; 179/1 VC; 362/80; 362/184; 362/190; 362/191; 362/208; 362/226; 362/800; 362/806; 367/197

[58] Field of Search ..... 362/103, 800, 35, 61, 362/184, 191, 190, 80, 208, 226, 806; 179/1 VC, 1 SD, 1 SP; 340/148

[56] References Cited

U.S. PATENT DOCUMENTS

| | | | |
|---|---|---|---|
| 1,977,997 | 10/1934 | Patterson | 179/1 SP |
| 2,140,224 | 12/1938 | Galgoczy . | |
| 2,245,769 | 6/1941 | Flamm . | |
| 2,502,566 | 4/1950 | Hooley . | |
| 2,505,154 | 12/1948 | Smith . | |
| 2,531,959 | 11/1950 | Woodard et al. | 362/103 |
| 3,737,647 | 6/1973 | Gonni | 362/800 |
| 3,798,208 | 1/1974 | Lewis | 362/103 |
| 4,164,008 | 8/1979 | Miller et al. | 362/800 |
| 4,240,132 | 12/1980 | Wickman | 362/103 |
| 4,298,910 | 11/1981 | Price | 362/103 |

*Primary Examiner*—Irwin Gluck

*Attorney, Agent, or Firm*—Bradford E. Kile

[57] ABSTRACT

A roller skate attachment operable to be fitted onto a roller skate having a shoe upper, a sole, a running gear attached to the sole and a toe stop releasably connected to a forward portion of the running gear. The attachment comprises a plurality of light emitting diodes releasably connected to the toe stop. A battery is operably mounted on the roller skate and an electrical circuit selectively interconnects the battery and the light emitting diodes to selectively light the diodes.

6 Claims, 6 Drawing Figures

ROLLER SKATE LIGHT ATTACHMENT

DESCRIPTION

TECHNICAL FIELD

This invention relates to an attachment operable to be mounted upon a conventional roller skate. More specifically this invention comprises a roller skate light attachment which advantageously enhances the visual presence of roller skates and skaters.

Roller skating has long been a healthful and invigorating form of recreation for both youth and adults. In the early stages of roller skate development wheels were mounted upon frames which in turn were merely strapped onto a skater's street shoes. As interest in the sport developed, roller skating equipment became more sophisticated. In this connection special shoes or boots were designed with a running gear securely mounted directly onto the sole of the shoe. The running gears were fitted with resilient connecting elements to facilitate turning and other desired maneuvers. In addition wheel bearings were refined to facilitate smooth rolling engagement of the wheels upon a skating surface. In addition wheel compositions were developed to provide enhanced wear characteristics and a degree of resilience to enable a skillful skater to glide across a skating surface in silent grace. Still further toe stops were added to a forward portion of the running gear to assist a skater in regulating speed and gracefully performing transition maneuvers.

As the quality of the skater's equipment developed competitions evolved in both individual and pairs skating. This competition further developed interest in roller skating as it displayed the grace, timing and strength aspects of the sport.

In addition to developments in the basic components of roller skates, attention has been focused on enhancing the asthetic aspects of the sport. One such asthetic element was the application of light units to roller skates.

Previously known light units included an incadecent light integrated into an upper toe portion of each skate with a generator unit connected to the skater's wheels to power the miniature headlights. Other designs were mounted upon the bottom of the skates and were powered by D.C. batteries mounted adjacent to the lights. Still further some have suggested that lights might be mounted directly upon peripheral edges of the wheels of roller skates.

While the attachment of a light units to roller skates has had at least a degree of theoretical appeal the acceptance of such previously known light units has been impaired and limited. More specifically a skater may not always want light units on a pair of skates. Lights built into the shoes, however, are permanent and will not readily admit to removal or alteration. Wheel mounted generating equipment is somewhat intricate and subject to failure. Moreover small generator units add undesirable weight to the running gear of skates.

In the recent past increased attention has been realized in roller skating generally and in particular in roller disco dancing and the like. In this regard it would be useful to provide a roller skate attachment operable to enhance the visual impact or presence of a roller disco performer. It would also be desirable to be able to provide roller skate light attachments which could be facilely added onto a conventional pair of roller skates. It would further be desirable to provide units which would be lightweight so as not to unduly tire a skater.

The difficulties suggested in the preceeding are not intended to be exhaustive, but rather are among many which have tended to reduce the acceptance and user satisfaction of prior roller skate lighting attachments. Other noteworthy problems and limitations may also exist; however, those presented above should be sufficient to demonstrate that roller skate lighting systems appearing in the past will admit to worthwhile improvement.

OBJECTS OF THE INVENTION

It is therefore a general object of the invention to provide a novel roller skate attachment which will obviate or minimize difficulties and limitations of the type previously described.

It is a particular object of the invention to provide a novel roller skate light attachment which is light weight and may be facilely mounted upon a conventional roller skate.

It is another object of the invention to provide a novel roller skate light attachment which may be modified or altered as desired.

It is a further object of the invention to provide a novel roller skate light attachment which is rugged and operably stable enough to withstand prolonged handling and utilization.

It is still another object of the invention to provide a novel roller skate light attachment which is operable to display a lighting pattern suitable to enhance the visual presence of a roller skater.

BRIEF SUMMARY OF A PREFERRED EMBODIMENT OF THE INVENTION

A preferred embodiment of the invention which is intended to accomplish at least some of the foregoing objects comprises a plurality of light emitting diodes (LEDs) which may be mounted within a toroidal shaped disc. The disc may be releasably attached between a toe stop and a forward portion of the running gear of a skate. A D.C. power supply is attached to the skate and an electrical circuit operably connects the battery to the LEDs.

In preferred embodiments the electrical circuit includes a simultaneous blinking control unit, a sequential blinking "chase" control unit or an audio actuated blinking control unit.

BRIEF DESCRIPTION OF DRAWINGS

Other objects and advantages of the present invention will become apparent from the following detailed description of preferred embodiments thereof taken in conjunction with the accompanying drawings, wherein.

DETAILED DESCRIPTION

Figure 1:
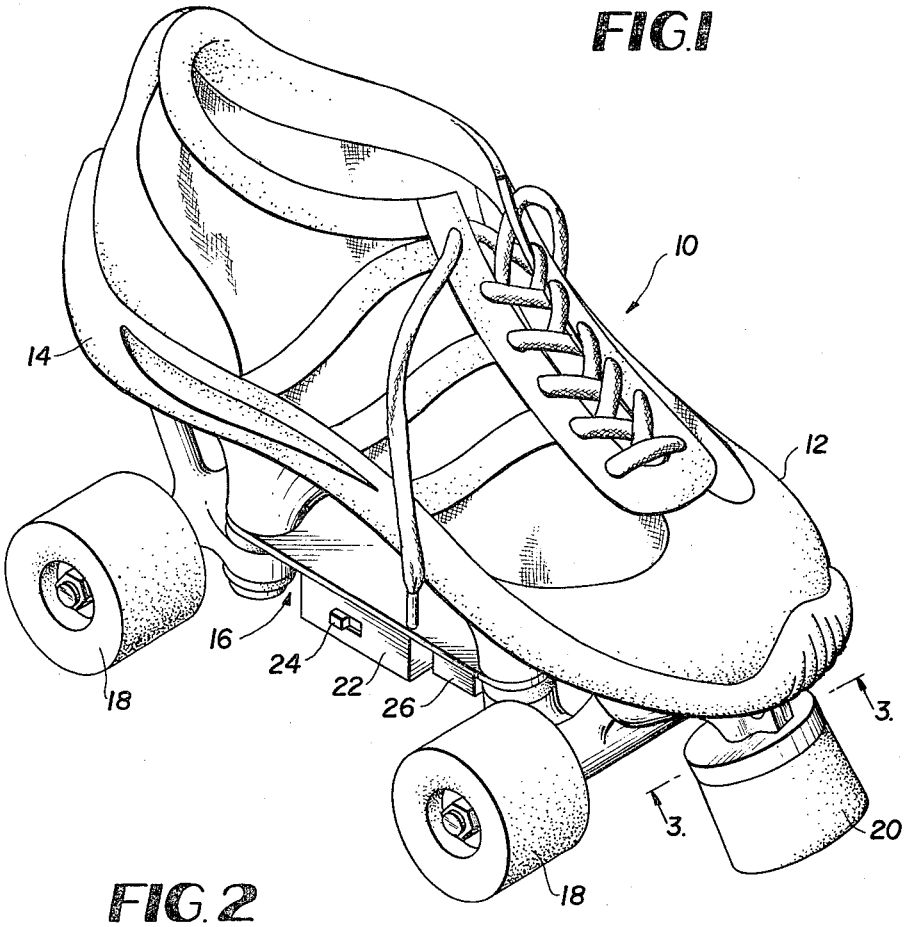
FIG. 1 is an axonometric view of a roller skate of the type operable to advantageously be fitted with the instant light emitting attachment.
Figure 2:
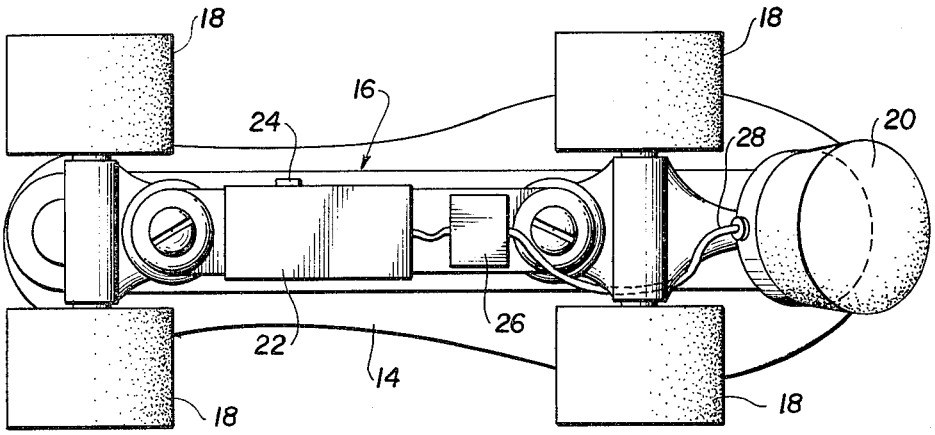
FIG. 2 is a bottom view of the roller skate depicted in FIG. 1.

Before discussing in detail the structural features of the subject invention, it may be worthwhile to establish the operating context of the invention. In this connection FIGS. 1 and 2 disclose a roller skate 10 of the type which may advantageously utilize the subject invention. More specifically the roller skate comprises a shoe upper 12 and a sole 14. Although a currently popular low top upper is disclosed in FIG. 1, it will be appreciated that high top shoes associated with competitive skating may also be utilized. A conventional running gear or frame 16 is mounted upon the sole of the shoe and carries a set of four wheels 18 which are typically composed of a polyurethane or rubber composition.

A convention toe stop 20, composed of a rubber composition or the like, is releasably mounted on a forward portion of the running gear in a conventional manner.

Turning to the subject invention a D.C. battery 22 is connected to the running gear 16 or some other portion of the roller skate and is electrically connected through a manual switch 24 to a control unit 26.

Figure 3:
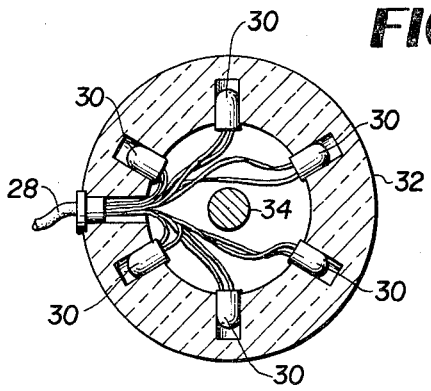
FIG. 3 is a detailed sectional view taken along section line 3—3 in FIG. 2 and discloses a plurality of light emitting diodes embedded within a toroidal shaped disc mounting member.

The control unit 26 is electrically connected via conduit 28 to a plurality of light emitting diodes (LEDs) 30 (note FIG. 3). The LEDs may be uniform in color or multi-colored as desired.

The LEDs are advantageously mounted, isolated and protected within a generally toroidal shaped disc 32. The disc 32 may be composed of a transparent or translucent epoxy compound or the like. The toroidal disc, carrying the LEDs, is releasably connected to the skate toe stop 20 by removing the toe stop from the running gear inserting a mounting shaft 34 of the running gear through the center of the torus and remounting the toe stop on the roller skate. Although other shaped carriers are envisioned by the subject invention the toroidal shaped disc 32 is a preferred configuration.

Figure 4:
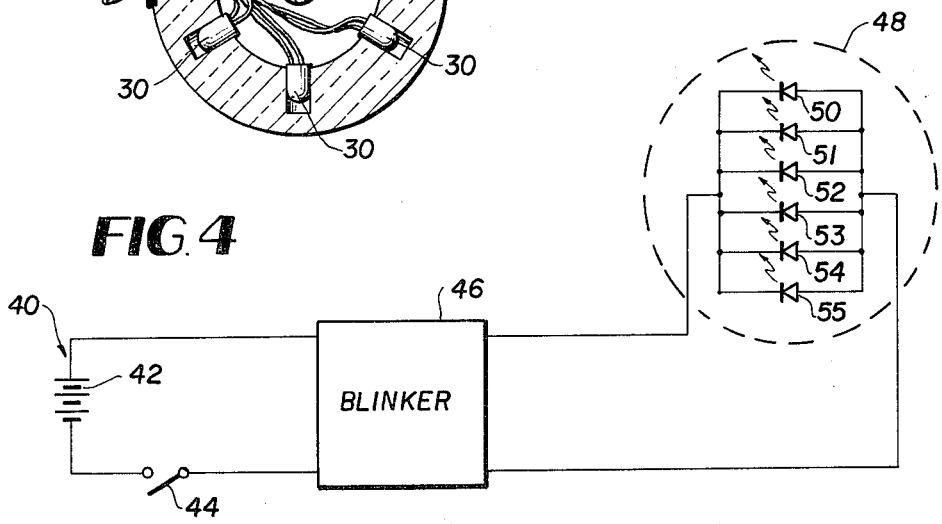
FIG. 4 is a circuit diagram of a blinker control circuit in accordance with a preferred embodiment of the invention for blinking the plurality of light emitting diodes to turn on and off in accordance with a predetermined frequency.

FIG. 4 is a circuit diagram for achievement of a blinking of the lights associated with the roller skate 10 as previously described.

As seen in FIG. 4, the blinking control circuit 40 comprises a power supply 42, switch 44, blinker circuit 46 and display indicators 48 (consisting of individual LED-type display indicators 50–55). In operation, actuation of switch 44 to the closed position causes application of DC voltage from the power supply 42 to the blinker circuit 46. Blinker circuit 46 responds to the application of the DC voltage so as to cause the individual LED-type display indicators 50–55 to turn on and off in accordance with a predetermined frequency.

It is to be noted that the blinker circuit 46 can be implemented by any one of various conventional circuits. For example, blinker circuit 46 can be composed of a low power blinker integrated circuit, type 7400, model no. 276-1801 (manufactured by Archer Electronic Parts). Alternatively, the blinker circuit 46 can be implemented by various flash circuits shown in *Electronic Circuits Manual,* edited by John Markus (New York: McGraw-Hill, Inc. 1971), chapter 30, pages 244–259. Such a flasher circuit is, for example, shown on page 256 of the aforementioned reference, and consists of a 24-volt lamp flasher which provides a variable flashing rate, adjustable by a potentiometer-resistor combination.

Figure 5:
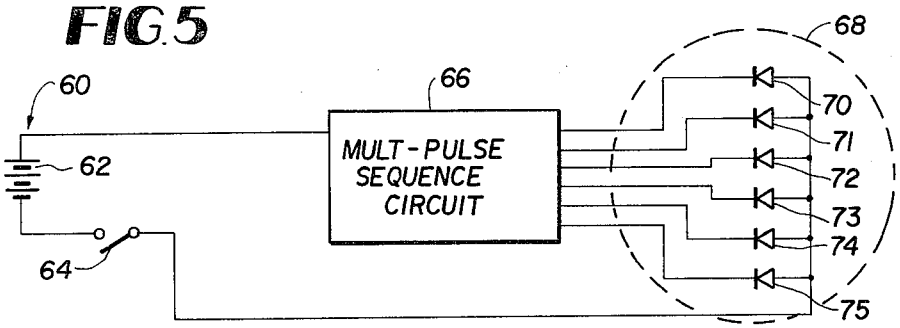
FIG. 5 is a circuit diagram of a sequential flashing circuit in accordance with an alternate preferred embodiment of the invention for causing sequential blinking or a "chase" pattern of the light emitting diodes.

FIG. 5 is a diagram of a circuit for achievement of sequential flashing of the lights associated with the roller skate previously described.

As seen in FIG. 5, the sequential flashing circuit 60 comprises a power supply 62, switch 64, multi-pulse sequence circuit 66 and display indicators 68 (consisting of individual LED-type display indicators 70–75). In operation, closing of switch 64 permits application of DC voltage from the power supply 62 to the multi-pulse sequence circuit 66. The multi-pulse sequence circuit 66 responds to the application of DC voltage so as to sequentially supply current to each of the individual LED-type display indicators 70–75, thus causing sequential blinking of the indicators 70–75.

It is to be noted that the multi-pulse sequence circuit 66 may be implemented by any conventional sequence circuit providing successive pulses on separate output lines. For example, the multi-pulse sequence circuit 66 can be implemented by the multi-pulse sequence generator shown in the aforementioned reference work, *Electronic Circuits Manual,* chapter 79, page 739. The sequence generator was originally developed by F. Cupp as a 4-pole sequence generator built with one hex-inverter, and was published in *Electronics* magazine (Feb. 3, 1969) pages 79–80. Of course, any other multi-pulse sequence circuit known to those of skill in the art can be used to implement the multi-pulse sequence circuit 66 of FIG. 5.

Figure 6:
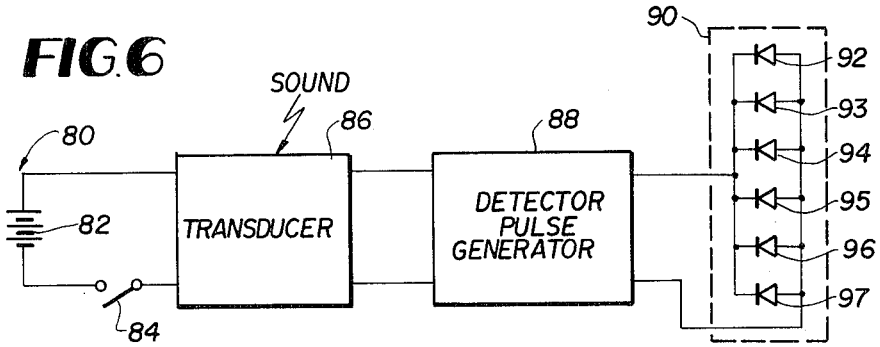
FIG. 6 is a circuit diagram of an audio-actuated blinking circuit in accordance with another preferred embodiment of the invention for inducing the light emitting diodes to blink on and off in response to an external audio signal.

FIG. 6 is a diagram of a circuit for achievement of sound-actuated blinking of the lights associated with the roller skate previously described.

As seen in FIG. 6, the sound-actuated blinking circuit 80 comprises a power supply 82, switch 84, electro-acoustic transducer 86, detector/pulse generator 88 and display indicators 90 (consisting of individual LED-type display indicators 92–97). In operation, closing of switch 84 causes application of DC voltage from power supply 82 to transducer 86. Transducer 86 is any conventional electro-acoustic transducer, and responds to sounds (such as music) so as to convert the received acoustic energy to electric energy in the form of a variable voltage output.

The variable voltage output of transducer 86 is provided to a conventional detector/pulse generator circuit 88. Detector/pulse generator circuit 88 detects the amplitude of the voltage input thereto, and, in accordance with a conventional threshold detection technique, generates one or more pulses whenever the voltage input to detector/pulse generator 88 exceeds the predetermined threshold. The output pulse(s) of detector/pulse generator 88 is (are) provided to the individual LED-type display indicators 92–97, causing them to light in accordance with the voltage threshold detection, and thus to light in correspondence to the sound received by the transducer 86. It is to be understood that transducer 86 and detector/pulse generator 88 can be implemented by any conventional electro-acoustic transducer and threshold detector/pulse generator, respectively, as known to those of skill in the art.

In describing the invention, reference has been made to preferred embodiments. Those skilled in the art, however, and familiar with the disclosure of the subject invention, may recognize additions, deletions, modifications, substitutions and/or other changes which will fall within the purview of the subject invention.

I claim:

1. A roller skate attachment operable to be fitted onto a roller skate having a shoe upper, a shoe sole, a running gear connected to the shoe sole and a toe stop releasably connected to a generally forward portion of the running gear, said roller skate attachment comprising:

toroidal shaped disc means releasably connected to a toe stop of the roller skate;

a plurality of light emitting diodes embedded within said toroidal shaped disc and being radially directed outwardly from the center of said disc said toroidal disc means being fabricated from a material which will permit said plurality of light emitting diodes to be visually detected through the disc material;

battery means operable to be connected to said roller skate; and circuit means interconnecting said battery means and said plurality of light emitting diodes for selectively transmitting current to actuate said light emitting diodes.

2. A roller skate attachment operable to be fitted onto a roller skate as defined in claim 1 wherein said toroidal shaped disc means comprises:

a transparent disc shaped torus operable to hold said plurality of light emitting diodes in a regularly spaced, peripheral ring, radially directed away from the center of said transparent disc, said disc shaped torus having an external diameter substantially equal to the diameter of the toe stop and being operable to fit between the top of the toe stop and the running gear of the roller skate.

3. A roller skate attachment operable to be fitted onto a roller skate as defined in claim 1 wherein said toroidal shaped disc means comprises:

a translucent disc shaped torus operable to hold said plurality of light emitting diodes in a regularly spaced, peripheral ring, radially directed away from the center of said translucent disc shaped torus having an external diameter substantially equal to the diameter of the toe stop and being operable to fit between the top of the toe stop and the running gear of the roller skate.

4. A roller skate attachment operable to be fitted onto a roller skate as defined in claim 1 wherein said circuit means comprises:

means for blinking said plurality of light emitting diodes on and off in unison at a predetermined frequency.

5. A roller skate attachment operable to be fitted onto a roller skate as defined in claim 1 wherein said circuit means comprises:

means for supplying current to said plurality of light emitting diode means in sequence for producing sequential blinking of said plurality of light emitting diode means.

6. A roller skate attachment operable to be fitted onto a roller skate as defined in claim 1 wherein said circuit means comprises:

acoustic transducer means and detector/pulse generator means for blinking said light emitting diode means in response to audio signals received by said acoustic transducer.

* * * * *